US006832684B2

(12) United States Patent
Huang

(10) Patent No.: US 6,832,684 B2
(45) Date of Patent: Dec. 21, 2004

(54) WRENCH SUPPORT RACK ASSEMBLY WITH A FASTENER DEVICE

(75) Inventor: Steve Huang, Taichung Hsien (TW)

(73) Assignee: Stanley Chiro International Ltd. (TW)

( * ) Notice: Subject to any disclaimer, the term of this patent is extended or adjusted under 35 U.S.C. 154(b) by 205 days.

(21) Appl. No.: 10/232,006

(22) Filed: Aug. 29, 2002

(65) Prior Publication Data

US 2004/0000497 A1 Jan. 1, 2004

(51) Int. Cl.[7] ..... B65D 85/20
(52) U.S. Cl. ..... 206/376; 211/70.6
(58) Field of Search ..... 206/376, 372; 211/70.6, 60.1; 220/243–244, 254.3, 254.7, 255, 256.1, 259.1, 324, 326

(56) References Cited

U.S. PATENT DOCUMENTS 5,598,924 A * 2/1997 McCann ..... 206/372
5,967,340 A * 10/1999 Kao ..... 211/70.6
D433,613 S * 11/2000 Jialin ..... D8/71
6,360,892 B1 * 3/2002 Chen ..... 206/376
6,679,391 B1 * 1/2004 Huang ..... 211/70.6
2002/0070185 A1 * 6/2002 Chen ..... 211/70.6
2003/0141266 A1 * 7/2003 Lin ..... 211/70.6

* cited by examiner

*Primary Examiner*—Bryon P. Gehman
(74) *Attorney, Agent, or Firm*—Ostrolenk, Faber, Gerb & Soffen, LLP

(57) ABSTRACT

A wrench support rack assembly includes a support rack defining a receiving space and having a base with left and right sides, left and right side plates extending respectively from the left and right sides of the base, and a retention cover pivoted to the left side plate and movable between covering and uncovering positions. A first latch arm extends from the cover to engage the support rack so as to prevent upward movement of the cover relative to the base when the cover is disposed at the covering position. A second latch arm extends from a flap that is connected to the cover to engage the support rack so as to prevent sidewise movement of the cover relative to the base when the cover is disposed at the covering position.

2 Claims, 8 Drawing Sheets

WRENCH SUPPORT RACK ASSEMBLY WITH A FASTENER DEVICE

BACKGROUND OF THE INVENTION

1. Field of the Invention

The present invention relates to a wrench support rack assembly, more particularly to a wrench support rack assembly with a fastener device to prevent undesired removal of wrenches disposed therein.

2. Description of the Related Art

A conventional wrench support rack assembly includes a support rack, a retention cover, and a fastener clip. The support rack includes a base with two opposite sides, and left and right side plates extending respectively and upwardly from the opposites sides of the base to define a wrench-receiving space therebetween. The retention cover has a pivot end mounted pivotally on the left side plate, and a distal end opposite to the pivot end. The retention cover is rotatable relative to the left side plate between a covering position, in which the distal end of the retention cover moves toward the right side plate so as to cover the wrench-receiving space, and an uncover position, in which the distal end of the retention cover moves away from the right side plate to permit access to the wrench-receiving space. The fastener clip extends transversely from the distal end of the retention cover to engage a latch groove formed in the right side plate when the retention cover is disposed at the covering position.

One disadvantage of the aforementioned wrench support rack assembly resides in that when wrenches are displayed on the wrench support rack assembly in a sales outlet, the retention cover can be easily opened to permit access to the wrenches, thereby resulting in misplacement or even loses of the wrenches.

SUMMARY OF THE INVENTION

Therefore, the object of this invention is to provide a wrench support rack assembly that is provided with an additional latch arm to prevent undesired removal of a retention cover relative to a support rack so as to eliminate the aforesaid disadvantage of the prior art.

Accordingly, a wrench support rack assembly of the present invention includes: a support rack including a base with two opposite side edges, and left and right side plates extending respectively and upwardly from the side edges of the base to define a wrench-receiving space therebetween; and a retention cover having a pivot end mounted pivotally on the left side plate, and a distal end opposite to the pivot end. The retention cover is rotatable relative to the left side plate of the support rack between a covering position, in which the distal end of the retention cover moves toward the right side plate so as to cover the wrench-receiving space, and an uncover position, in which the distal end of the retention cover moves away from the right side plate to permit access to the wrench-receiving space. A fastener device includes a flap flexibly connected to the distal end of the retention cover, a first latch arm extending transversely from the retention cover adjacent to the distal end, a second latch arm extending transversely from the flap, a first latch groove formed in the right side plate and engaging the first latch arm when the retention cover is disposed at the covering position, thereby preventing upward movement of the retention cover relative to the support rack, and a second latch groove formed in the right side plate, spaced apart from the first latch groove, and engaging the second latch arm when the retention cover is disposed at the covering position, thereby preventing sidewise movement of the flap relative to the right side plate of the support rack. The first and second latch arms are extend in transverse directions when the retention cover is disposed at the covering position.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
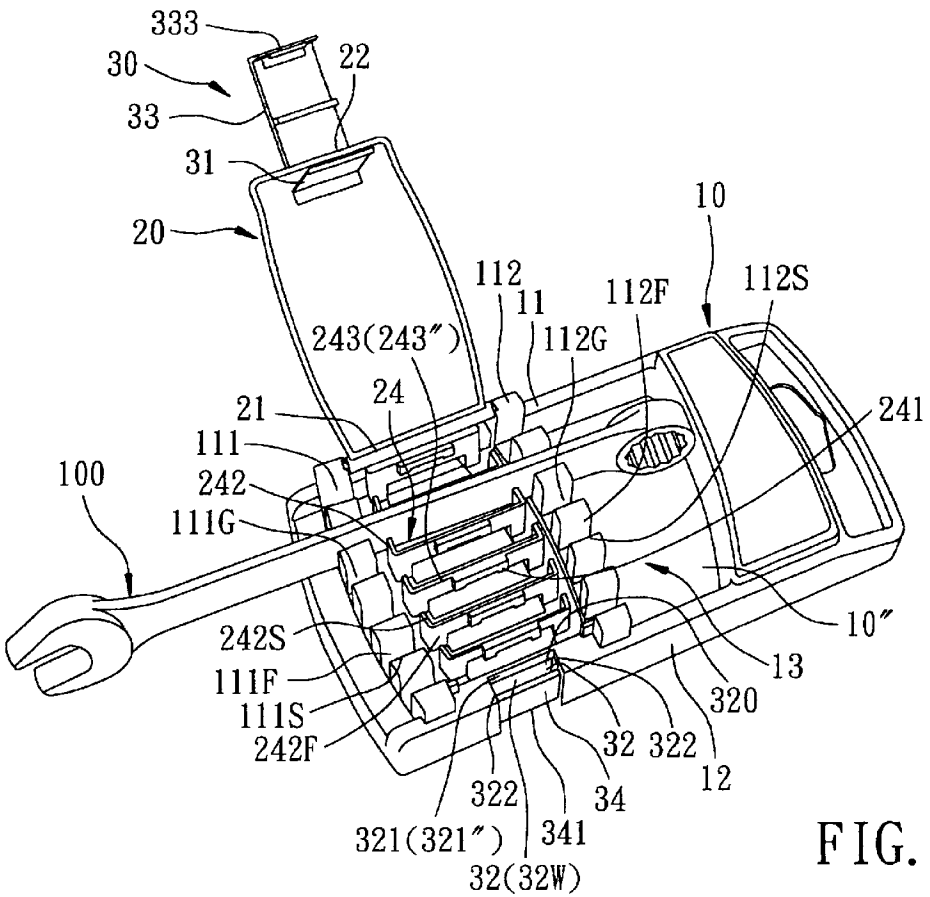
FIG. 1 is a perspective view of a preferred embodiment of a wrench support rack assembly according to the present invention, illustrating a retention cover disposed at an uncover position.
Figure 2:
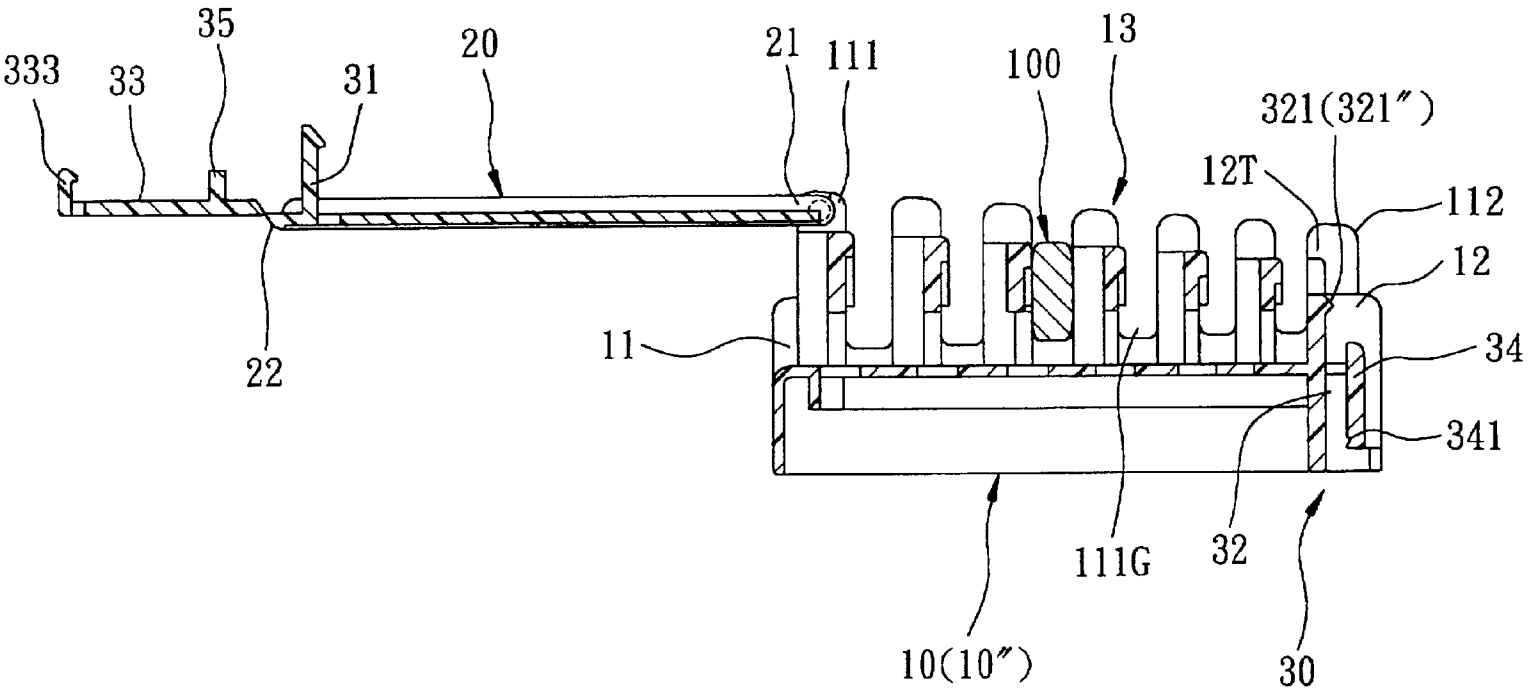
FIG. 2 is a schematic sectional side view of the preferred embodiment shown in FIG. 1.
Figure 3:
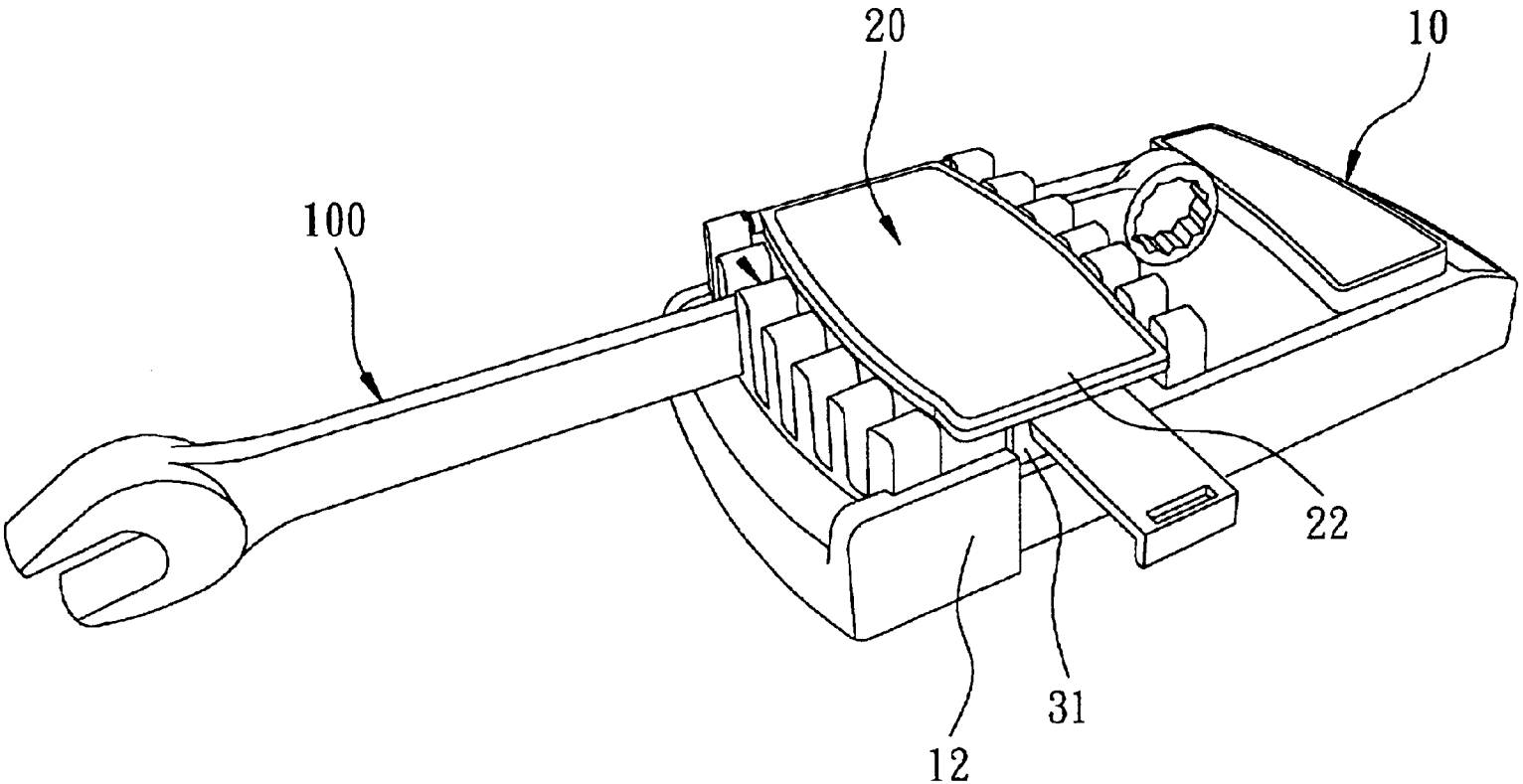
FIG. 3 is a perspective view of the preferred embodiment, illustrating the retention cover disposed at a covering position.

Referring to FIGS. 1 to 3, the preferred embodiment of a wrench support rack assembly according to the present invention is shown to include a support rack 10, a retention cover 20, and a fastener device 30.

As illustrated, the support rack 10 includes a base 10", and left and right side plates 11, 12. The base 10" has two opposite sides. The left and right side plates 11, 12 extend respectively and upwardly from the opposites sides of the base 10" to define a wrench-receiving space 13 therebetween.

The retention cover 20 has a pivot end 21 mounted pivotally on the left side plate 11, and a distal end 22 opposite to the pivot end 21. The retention cover 20 is rotatable relative to the left side plate 11 between a covering position, in which the distal end 22 of the retention cover 20 moves toward the right side plate 12 so as to cover the wrench-receiving space 13, as best shown in FIG. 3, and an uncover position, in which the distal end 22 of the retention cover 20 moves away from the right side plate 12 to permit access to the wrench-receiving space 13, as best shown in FIG. 2.

Figure 4:
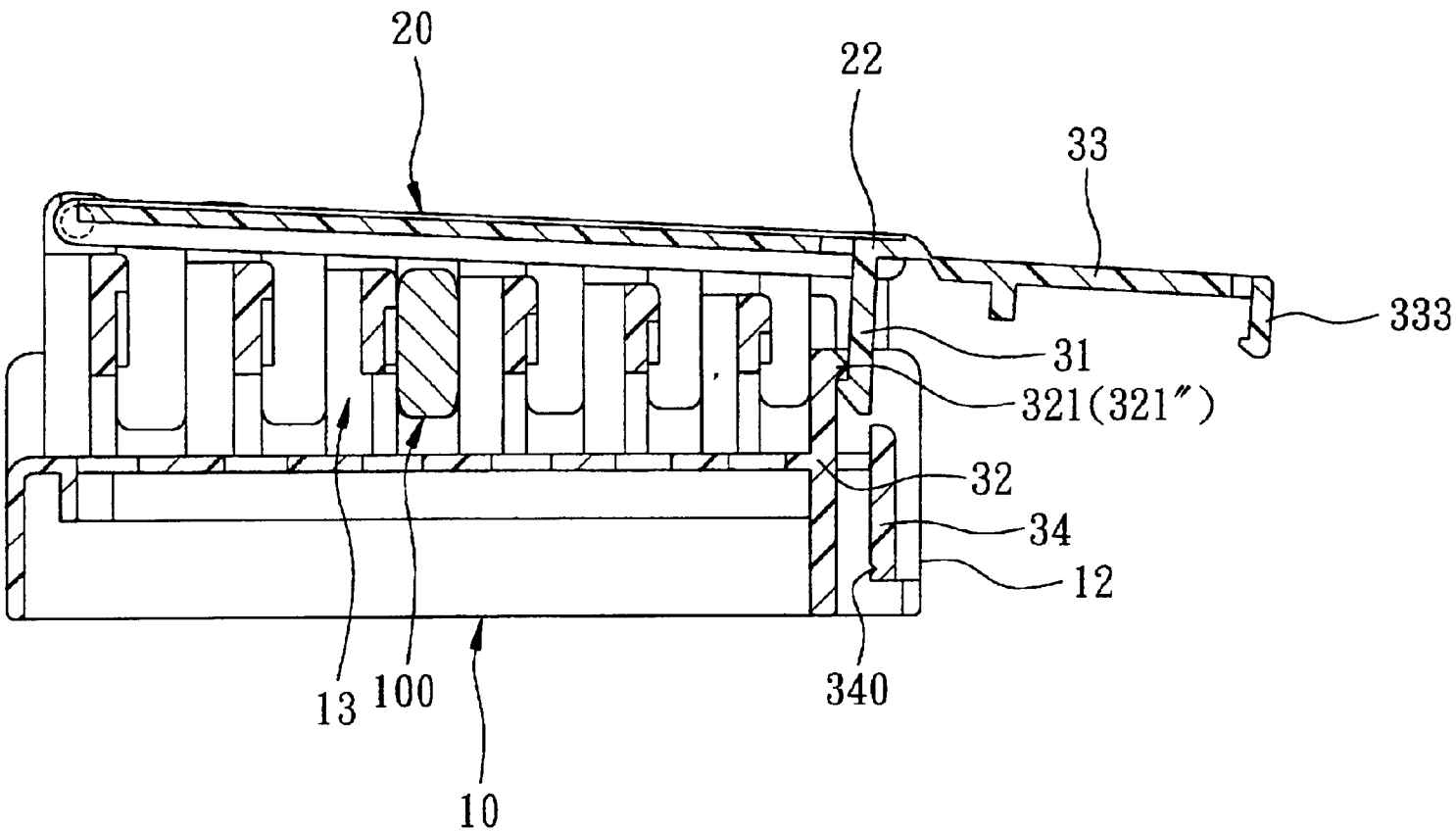
FIG. 4 is a sectional view of the preferred embodiment, illustrating how a latch arm mounted on the retention cover engages a latch groove formed in a side plate.
Figure 5:
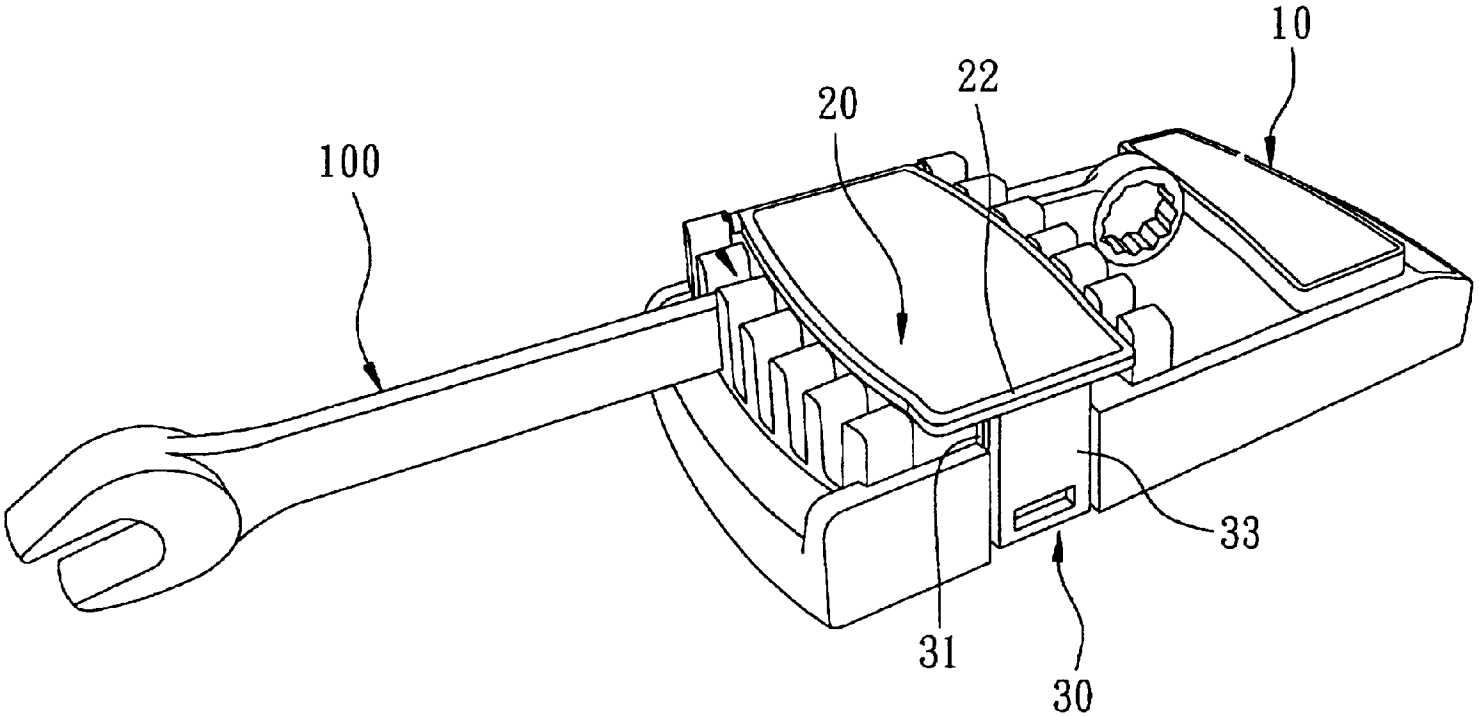
FIG. 5 is a perspective view of the preferred embodiment, illustrating the latch arm engaging the latch groove.
Figure 6:
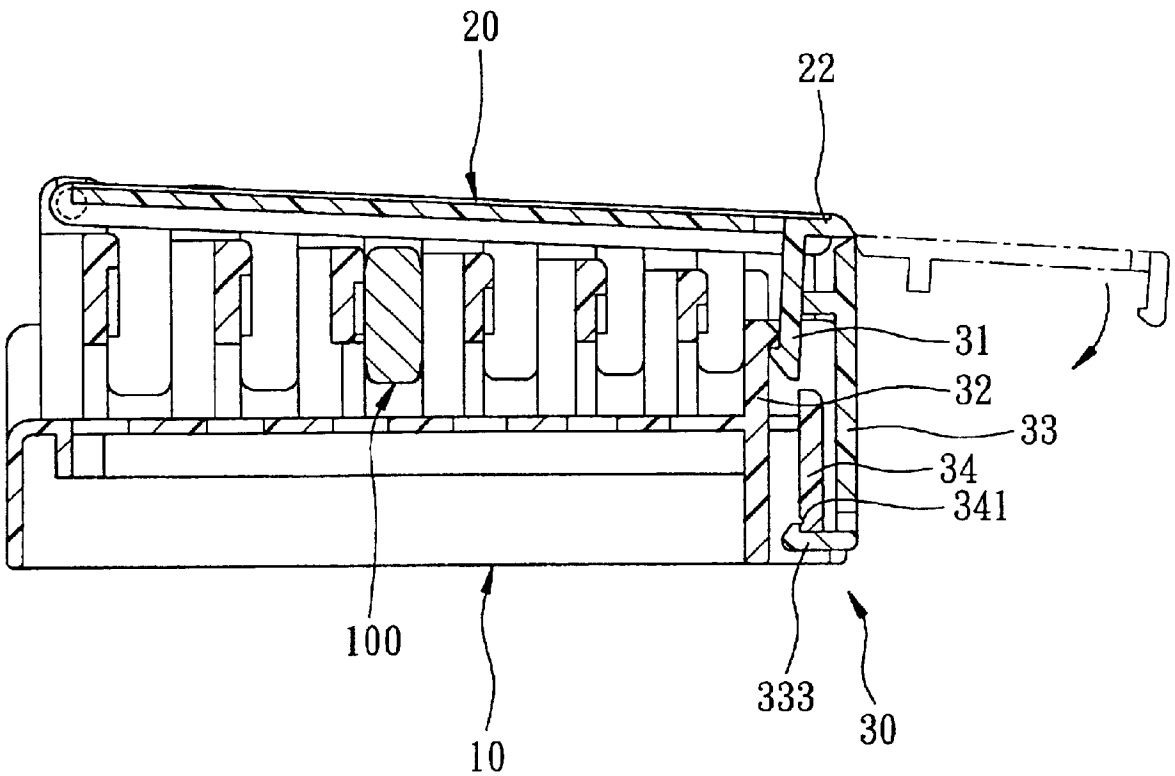
FIG. 6 is a sectional view of the preferred embodiment, illustrating how two latch arms engaging two latch grooves formed in the side plate so as to prevent upward and sidewise removal of the retention cover from a base.

The fastener device 30 includes a flap 33, a first latch arm 31, a second latch arm 333, a first latch groove 321, and a second latch groove 341. The flap 33 is flexibly connected to the distal end 22 of the retention cover 20. The first latch arm 31 extends transversely from the retention cover 20 adjacent to the distal end 22. The second latch arm 333 extends transversely from the flap 33. The first latch groove 321 is formed in the right side plate 12 and engages the first latch arm 31 when the retention cover 20 is disposed at the covering position, thereby preventing upward movement of the retention cover 20 relative to the support rack 10, as best shown in FIG. 4. The second latch groove 341 is formed in the right side plate 12, is spaced apart from the first latch arm 333 when the retention cover 20 is disposed at the covering position, thereby preventing sidewise movement of the flap 33 relative to the right side plate 12 of the support rack 10, as best shown in FIGS. 5 and 6. The first and second latch arms 31, 333 extend in transverse directions when the retention cover 20 is disposed at the covering position (see FIG. 6).

In this embodiment, the right side plate 12 has a top end 12T and a projection 321, and is formed with a generally U-shaped recess 32 that is confined by a recess-confining wall 32W and that includes an innermost wall portion 320 and two lateral wall portions 322. The projection 321" protrudes outwardly and laterally from the innermost wall portion 320 adjacent o the top end 12T of the right side plate 12. The innermost wall portion 320 cooperates with the projection 321" to define the first latch groove 321 therebetween. The lateral wall portions 322 extend transversely and respectively from two opposite ends of the innermost wall portion 320. The right side plate 12 further includes a bar 34 that is disposed in the recess 32 and that interconnects the lateral wall portions 322. The bar 34 has a bottom end disposed at an elevation below the projection 321", and an inner side face confronting and spaced apart from the innermost wall portion 320. The second latch groove 341 is formed in the inner side face of the bar 34 adjacent to the bottom end thereof. The fastener device 30 further includes an abutting member 35 extending transversely from the flap 33 and disposed to press against the first latch arm 31 when the retention cover 20 is disposed at the covering position.

Figure 7:
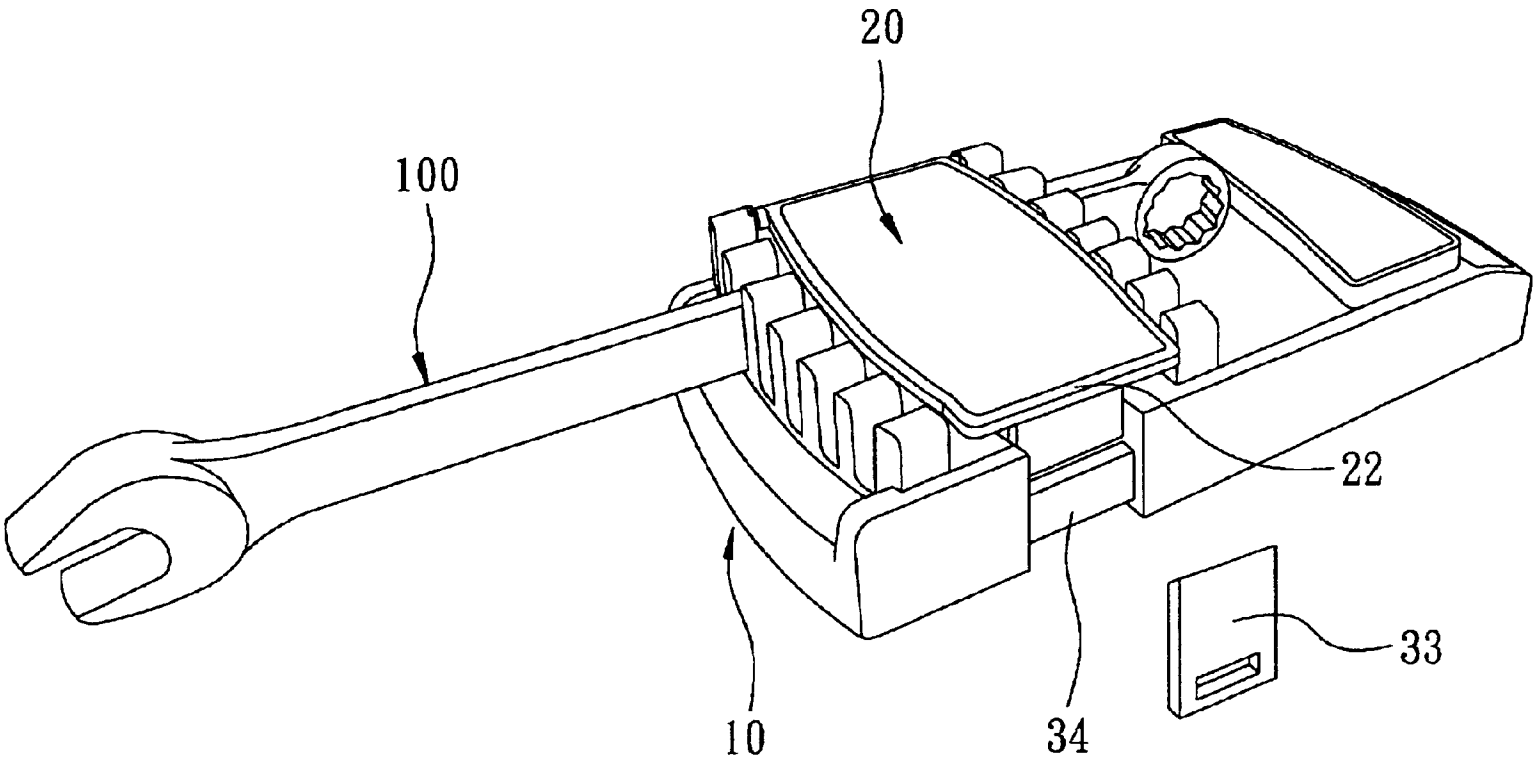
FIGS. 7 and 8 illustrate how one of the latch arms is severed from the retention cover.
Figure 8:
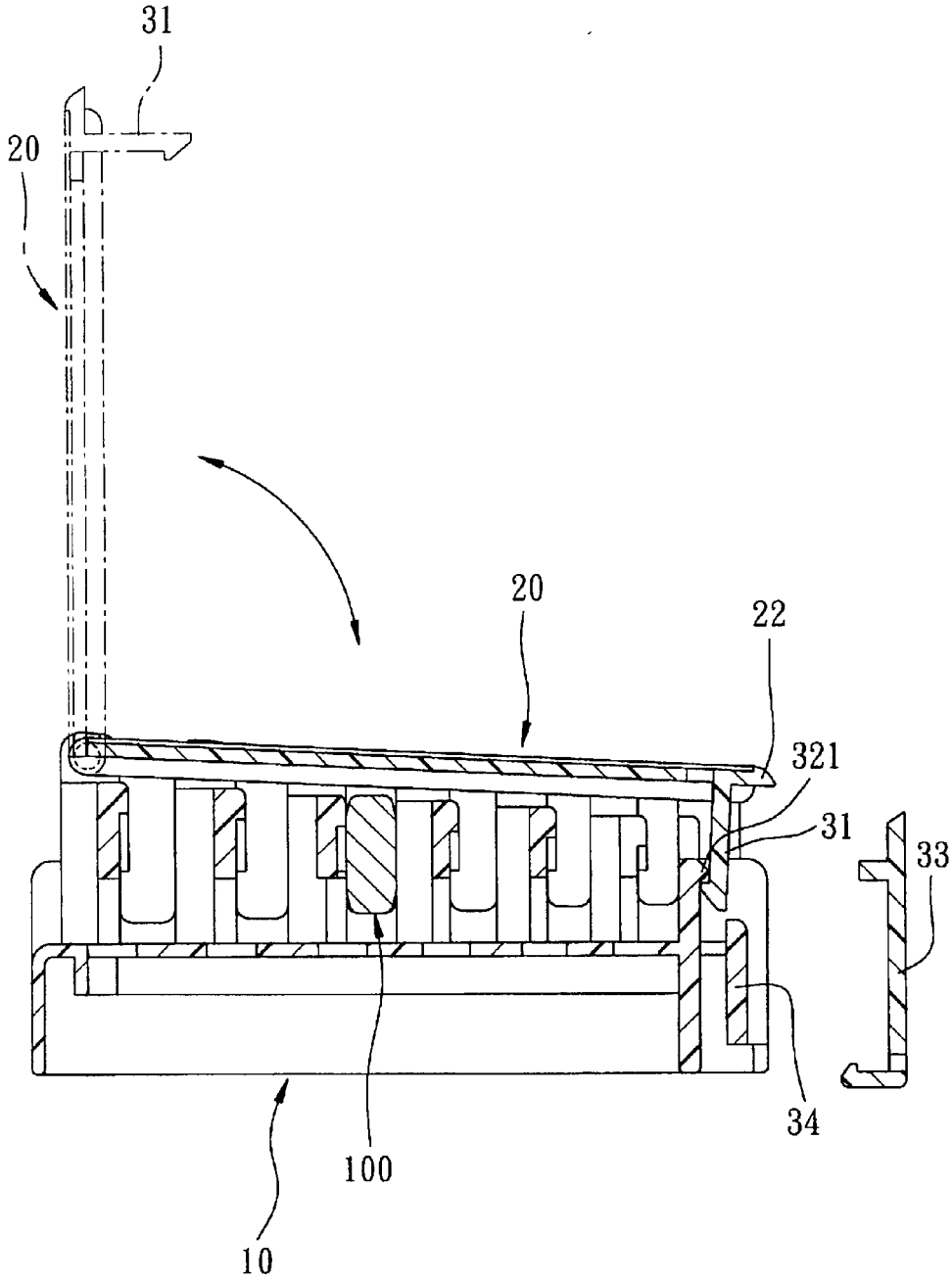

Referring to FIGS. 7 and 8, after purchase of the wrench support rack assembly of the present invention, the flap 33 can be severed from the retention cover 20 by cutting along the distal end 22 of the retention cover 20 so that a little upward force on the retention cover 20 results in movement of the distal end of the retention cover 20 away from the support rack 10.

Referring again to FIG. 1, the support rack 10 further includes a plurality of first confining members 111, and a plurality of second confining members 112. The first and second confining members 111, 112 extend uprightly from the base 10", and are respectively aligned with one another in a longitudinal direction. An adjacent pair of the first confining members 111 define a first groove (111G) therebetween, and have opposing first and second groove-defining faces (111F, 111S) which cooperatively confine the first groove (111G) and which are spaced apart from each other by a first distance. An adjacent pair of the second confining members 112 define a second groove (112G) therebetween, and have opposing first and second groove-defining faces (112F, 112S) which cooperatively confine the second groove (112G) and which are spaced apart from each other by the first distance, such that when a wrench 100 is disposed in the wrench support rack assembly of the present invention, the stem of the wrench 100 extends through the first and second grooves (111G, 112G) (see FIG. 1). A plurality of pressing members 24 are disposed between and are spaced apart from the first confining members 111 and the second confining members 112. Each of the pressing member 24 includes an L-shaped first leg 242 that is disposed proximate to the first groove-defining face (111F) of a respective one of the first confining members 111, that extends upwardly from the base 10", and that has a first section (242F) extending in the longitudinal direction and a second section (242S) extending from the first section (242F) in a transverse direction relative to the longitudinal direction, an L-shaped second leg 242 that is disposed proximate to the first groove-defining face (112F) of a respective one of the second confining members 112, that extends upwardly from the base 10", and that has a first section (242F) extending in the longitudinal direction and a second section (242S) extending from the first section (242F) in the transverse direction, and a bridging portion 243 which interconnects the first sections (242S) of the L-shaped first and second legs 242 and which is formed with a protrusion 243"having an abutment face 241 parallel to and spaced apart from a plane, which is co-planar with the second groove-defining faces (111S, 112S) of the respective first and second confining members 111, 112, by a second distance that is shorter than the first distance. As such, the abutment face 241 of the bridging portion 243 resiliently presses the stem of the wrench 100 against the second groove-defining faces (111S, 112S) of the respective first and second confining members 111, 112 when the wrench 100 is disposed in the first and second grooves (111G, 112G). Preferably, the bridging member 243 of each of the pressing members 24 has a bottom that is spaced apart from the base 10" of the support rack 10.

With this invention thus explained, it is apparent that numerous modifications and variations can be made without departing from the scope and spirit of this invention. It is therefore intended that the invention be limited only as indicated in the appended claims.

I claim:

1. A wrench support rack assembly comprising:

a support rack including a base with two opposite side edges, and left and right side plates extending respectively and uprightly from said opposite side edges of said base to define a wrench-receiving space therebetween;

a retention cover having a pivot end mounted pivotally on said left side plate, and a distal end opposite to said pivot end, said retention cover being rotatable relative to said left side plate between a covering position, in which said distal end of said retention cover moves toward said right side plate so as to cover said wrench-receiving space, and an uncover position, in which said distal end of said retention cover moves away from said right side plate to permit access to said wrench-receiving space; and a fastener device including a flap flexibly connected to said distal end of said retention cover, a first latch arm extending transversely from said retention cover adjacent to said distal end, a second latch arm extending transversely from a distal end of said flap, a first latch groove formed in said right side plate and engaging said first latch arm when said retention cover is disposed at said covering position, thereby preventing upward movement of said retention cover relative to said support rack, and a second latch groove formed in said right side plate, spaced apart from said first latch groove, and engaging said second latch arm when said retention cover is disposed at said covering position, thereby preventing sidewise movement of said flap relative to said right side plate of said support rack, said first and second latch arms extending in transverse directions with respect to each other when said retention cover is disposed at said covering position.

2. The wrench support rack assembly as defined in claim 1, wherein said right side plate has a top end and a projection, and is formed with a generally U-shaped recess confined by a recess-confining wall and including an innermost wall portion that has two opposite ends and that cooperates with said projection to define said first latch groove therebetween, and two lateral wall portions extending respectively from said opposite ends of said innermost wall portion, said projection protruding outwardly and laterally from said innermost wall portion adjacent to said top end, said right side plate further including a bar disposed in said recess and interconnecting said lateral wall portions, said bar having a bottom end disposed at an elevation below said projection, and an inner side face confronting and spaced apart from said innermost wall portion, said second latch groove being formed in said inner side face of said bar adjacent to said bottom end of said bar.

* * * * *